US008746697B2

(12) United States Patent
Kondo

(10) Patent No.: US 8,746,697 B2
(45) Date of Patent: Jun. 10, 2014

(54) SHEET TRANSPORT MECHANISM AND IMAGE FORMING APPARATUS HAVING THE SAME

(71) Applicant: KYOCERA Document Solutions Inc., Osaka (JP)

(72) Inventor: Kazuhisa Kondo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/953,265

(22) Filed: Jul. 29, 2013

(65) Prior Publication Data

US 2014/0035225 A1 Feb. 6, 2014

(30) Foreign Application Priority Data

Jul. 31, 2012 (JP) ..... 2012-169881

(51) Int. Cl.
*B65H 5/02* (2006.01)

(52) U.S. Cl.
USPC ..... 271/274; 271/272; 271/273

(58) Field of Classification Search
USPC ..... 271/272, 273, 274
See application file for complete search history.

(56) References Cited

U.S. PATENT DOCUMENTS

| | | | | |
|---|---|---|---|---|
| 5,762,332 | A * | 6/1998 | Haroutel et al. | 271/274 |
| 7,252,287 | B2 * | 8/2007 | Tsutoh | 271/274 |
| 7,500,670 | B2 * | 3/2009 | Kitazawa | 271/274 |
| 7,828,292 | B2 * | 11/2010 | Kitazawa | 271/274 |
| 7,900,919 | B2 * | 3/2011 | Ledgerwood et al. | 271/274 |
| 2005/0040583 | A1 * | 2/2005 | Murakami et al. | 271/65 |
| 2006/0012112 | A1 | 1/2006 | Kitazawa | |
| 2009/0140486 | A1 | 6/2009 | Kitazawa | |

FOREIGN PATENT DOCUMENTS

| | | | |
|---|---|---|---|
| CN | 1721305 | A | 1/2006 |
| CN | 100513279 | C | 7/2009 |
| JP | 2005-060089 | A | 3/2005 |
| JP | 2006-027811 | A | 2/2006 |
| JP | 2006-318527 | A | 11/2006 |

* cited by examiner

*Primary Examiner* — Kaitlin Joerger
(74) *Attorney, Agent, or Firm* — Knobbe, Martens, Olson & Bear LLP

(57) ABSTRACT

A sheet transport mechanism includes a pair of transport rollers and a roller pressing mechanism. The roller pressing mechanism includes one pair of first levers, one pair of second levers, and an elastic member. The one pair of first levers are supported to swing around a first swing shaft. A rotary shaft of a second roller of the pair of transport rollers is rotatably supported by a bearing aperture formed at substantially a center of the first lever. In addition, the one pair of second levers are supported to swing around the second swing shaft. Both ends of the elastic member are connected to tip ends of the second levers. The end of each second lever rotates around the second swing shaft, and presses the first lever toward the first roller of the pair of transport rollers.

7 Claims, 6 Drawing Sheets

SHEET TRANSPORT MECHANISM AND IMAGE FORMING APPARATUS HAVING THE SAME

INCORPORATION BY REFERENCE

This application claims priority to Japanese Patent Application No. 2012-169881 filed on Jul. 31, 2012, the entire contents of which are incorporated by reference herein.

BACKGROUND

The present disclosure relates to a sheet transport mechanism which transports a sheet-like recording medium such as paper in an image forming apparatus such as a facsimile, a copying machine, or a printer.

In the image forming apparatus such as the facsimile, the copying machine, or the printer, the sheet transport mechanism, which rotates a pair of transport rollers pressed against one pair of rollers, and nips and transports a sheet in a nip of the pair of transport rollers, is widely used as means for transporting a sheet (recording medium) such as paper, cloth, or an overhead projector (OHP) sheet.

In the above-described sheet transport mechanism, one roller of the pair of transport rollers is pressed against the other roller through a tension spring, a compression spring, or the like at a predetermined pressure. Generally, in some image forming apparatuses, one roller is pressed against the other roller by providing a separate urging member at each end of an axial direction of the pair of transport rollers.

However, in the above-described configuration, the urging member is disposed in a direction orthogonal to the axial direction of the roller so that an urging direction of the urging member is the same as a pressing direction of the roller. Here, when a short spring with a small number of turns is used to reduce a size of a width direction of the sheet transport mechanism (contact and separation directions of the pair of rollers), a spring constant is increased. Because an influence of a dimension error of a component for fixing the spring on a pressing force is increased when a spring with a large spring constant has been used, the processing force of the pair of transport rollers becomes a factor that differs between left and right of the axial direction. As a result, a sheet transporting force is uneven in the left and right of the axial direction, and becomes the cause of a skew, jam, or the like of a sheet.

In order to solve the above-described defect, for example, a sheet-material transport apparatus including one pair of transport rollers, one pair of driven rollers respectively driven by the transport rollers, one pair of pressure sections configured to press the one pair of driven rollers to the one pair of transport rollers, and a tension spring configured to extend between the pressure sections of one pair and assign a uniform pressure force to the one pair of pressure sections is proposed.

SUMMARY

As an aspect of the present disclosure, technology obtained by further improving the above-described related art is proposed.

According to an aspect of the present disclosure, there is provided a sheet transport mechanism including: a pair of transport rollers, one pair of first levers, one pair of second levers, and an elastic member.

The pair of transport rollers include a first roller which is rotated by a driving force from a drive source, and a second roller which is pressed against the first roller and driven to be rotated, the pair of transport rollers being configured to nip and transport a recording medium in a nip portion between the first roller and the second roller.

The one pair of first levers are provided at both ends of a rotary shaft of the second roller, each of the pair of first levers having a bearing aperture which rotatably supports the rotary shaft, each of the pair of first levers being configured to swing in directions of contact with and separation from the first roller with a first swing shaft extending in a direction parallel to rotary shafts of the first and second rollers as a rotation center.

The one pair of second levers are arranged to swing in the directions of contact with and separation from the first roller around second swing shafts each provided orthogonal to the associated first swing shaft and a pressing direction of the second roller and lateral to an associated one of the pair of first levers, the pair of second levers being configured to cause the first levers to move in the directions of contact with and separation from the first roller when one ends of the pair of second levers abut the first levers.

The elastic member is connected to the other ends of the pair of second levers and configured to pull the pair of second levers toward a center of the rotary shaft of the second roller in a direction parallel to the rotary shaft of the second roller, the elastic member being disposed at a position between the rotary shaft of the first roller and the rotary shaft of the second roller in the directions of contact and separation of the second roller with and from the first roller.

Further, when the elastic member pulls the other ends of the pair of second levers, the one ends of the pair of second levers swing in a direction toward the pair of first levers being pressed, so that the pair of second rollers are pressed against the pair of first rollers.

DETAILED DESCRIPTION

Figure 1:
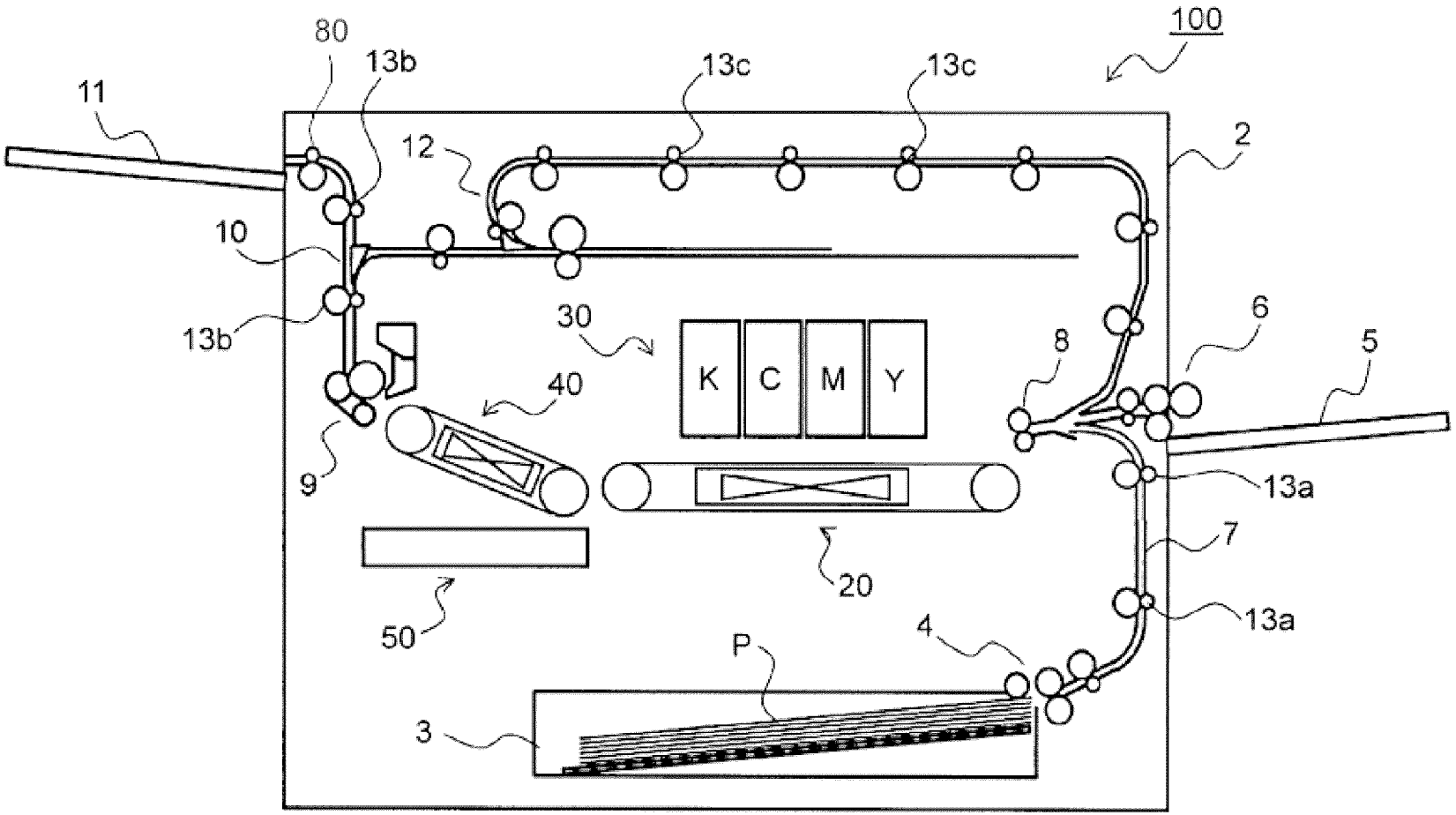
FIG. 1 is a side cross-sectional view illustrating an internal configuration of a printer which is an example of an image forming apparatus including a sheet transport apparatus according to the present disclosure.

Hereinafter, a sheet transport mechanism and an image forming apparatus according to an embodiment will be described as an aspect of the present disclosure with reference to the drawings. FIG. 1 is a side cross-sectional view illustrating an internal configuration of an inkjet printer 100 which is an example of the image forming apparatus on which the sheet transport mechanism according to the present disclosure is mounted.

As illustrated in FIG. 1, in the printer 100, a paper feeding cassette 3, which is a paper housing section, is disposed on an internal lower part of a printer main body 2. Inside the paper feeding cassette 3, a predetermined number of (for example, about 500) sheets of paper P such as cut paper before printing, which is an example of a recording medium, are loaded and housed. At a downstream side of a paper transport direction of the paper feeding cassette 3, that is, above the right side of the paper feeding cassette 3 in FIG. 1, a paper feeding apparatus 4 is disposed. Through the paper feeding apparatus 4, the paper P is directed to the upper right part of the paper feeding cassette 3 in FIG. 1 and separated and fed sheet by sheet. The paper feeding cassette 3 is horizontally drawn from the front side of the printer main body 2 and filled with the paper P.

A manual paper feeding tray 5 is provided outside the right side of the printer main body 2. On the manual paper feeding tray 5, paper having a size different from the paper P within the paper feeding cassette 3, recording media, which are difficult to pass through a curved transport path, such as thick paper, an OHP sheet, an envelope, a postcard, and an invoice, recording media desired to be manually fed one by one, and the like are placed. The paper feeding apparatus 6 is disposed on the downstream side of the paper transport direction of the manual paper feeding tray 5, that is, on the left side of the manual paper feeding tray 5 in FIG. 1. Through the paper feeding apparatus 6, paper on the manual paper feeding tray 5 is separated sheet by sheet and fed to the left in FIG. 1.

In addition, the printer 100 internally includes a first paper transport path 7. The first paper transport path 7 is positioned on the upper right side which is a paper feeding direction in terms of the paper feeding cassette 3, and positioned on the left in terms of the manual paper feeding tray 5. Paper P fed from the paper feeding cassette 3 is transported upward in a vertical direction along a side surface of the printer main body 2 through the first paper transport path 7 and the paper fed from the manual paper feeding tray 5 is transported to the left in a substantially horizontal direction.

A resist roller pair 8 is provided at a downstream end of the first paper transport path 7 in the paper transport direction. Further, a first belt transport section 20 and a recording section 30 are disposed in the vicinity of a downstream side of the resist roller pair 8. The paper P fed from the paper feeding cassette 3 (or the manual paper feeding tray 5) reaches the resist roller pair 8 through the first paper transport path 7. The resist roller pair 8 measures the timing of an ink ejection operation to be executed by the recording section 30 while correcting diagonal feeding of the paper P, and feeds the paper P toward the first belt transport section 20. The transport roller pair 13*a* for transporting the paper P to the first paper transport path 7 is provided in an appropriate position.

In addition, in order to prevent an ink ejection defect due to drying or clogging of a recording head, the recording section 30 is prepared in the next printing operation by executing a purge operation of ejecting ink having high viscosity within a nozzle from all ink ejection nozzles (not illustrated) of the recording head at the initiation of printing after long-term stoppage or from an ink ejection nozzle of which an ink ejection amount is less than or equal to a specified value during a printing operation.

A second belt transport section 40 is disposed on the downstream side (the left of FIG. 1) of the first belt transport section 20 in the paper transport direction. Paper P on which an ink image is recorded by the recording section 30 is fed to the second belt transport section 40. Ink ejected to the surface of the paper P is dried while the paper P passes through the second belt transport section 40.

A decurler section 9 is provided in the vicinity of a left-side surface of the printer main body 2 on the downstream side of the second belt transport section 40 in the paper transport direction. The paper P on which the ink is dried by the second belt transport section 40 is fed to the decurler section 9, and curling is corrected using a plurality of rollers arranged in a paper width direction.

A second paper transport path 10 is provided on the downstream side (the upper part of FIG. 1) of the decurler section 9 in the paper transport direction. When double-sided recording on the paper P passing through the decurler section 9 is not performed, the paper P is discharged from the second paper transport path 10 to a paper discharge tray 11 provided outside the left-side surface of the printer 100 via a discharge roller pair 80. In the second paper transport path 10, as in the first paper transport path 7, a transport roller pair 13*b* for transporting the paper P is provided in an appropriate position.

In addition, a maintenance unit 50 is disposed below the second belt transport section 40. The maintenance unit 50 moves below the recording section 30 when executing the above-described purge, wipes ink ejected from the ink ejection nozzle of the recording head, and collects the wiped ink.

In the upper portion of the printer main body 2, a reverse transport path 12 for performing double-sided recording is provided above the recording section 30 and the second belt transport section 40. When the double-sided recording has been performed, the paper P passing through the second belt transport section 40 and the decurler section 9 after the end of recording on a first side is fed to the reverse transport path 12 through the second paper transport path 10. Subsequently, the transport direction for recording on a second side is switched, and the paper P fed to the reverse transport path 12 is fed to the right side through the upper part of the printer main body 2 and re-fed to the first belt transport section 20 in a state in which the second side has been directed upward through the first paper transport path 7 and the resist roller pair 8. In the reverse transport path 12, as in the first paper transport path 7, a transport roller pair 13*c* for transporting the paper P is provided in an appropriate position.

Figure 2:
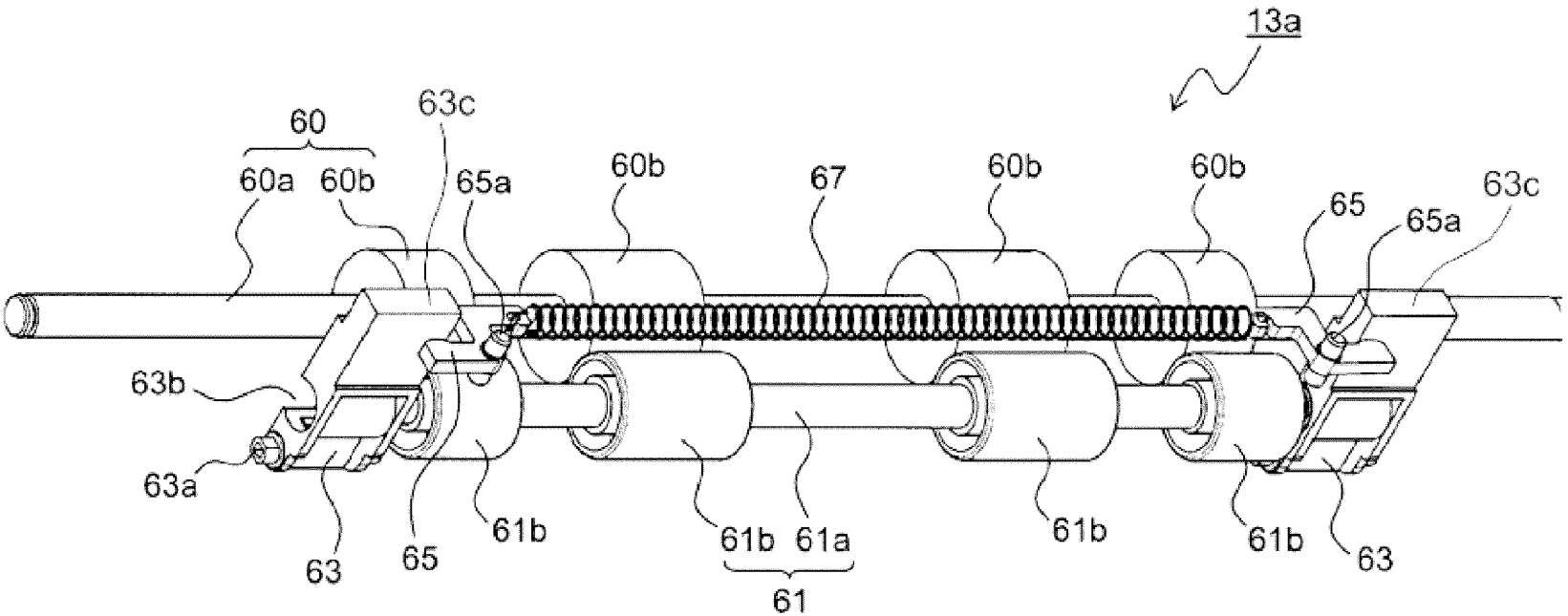
FIG. 2 is a perspective view of one pair of transport rollers which are an example of the sheet transport apparatus according to a first embodiment of the present disclosure.
Figure 3:
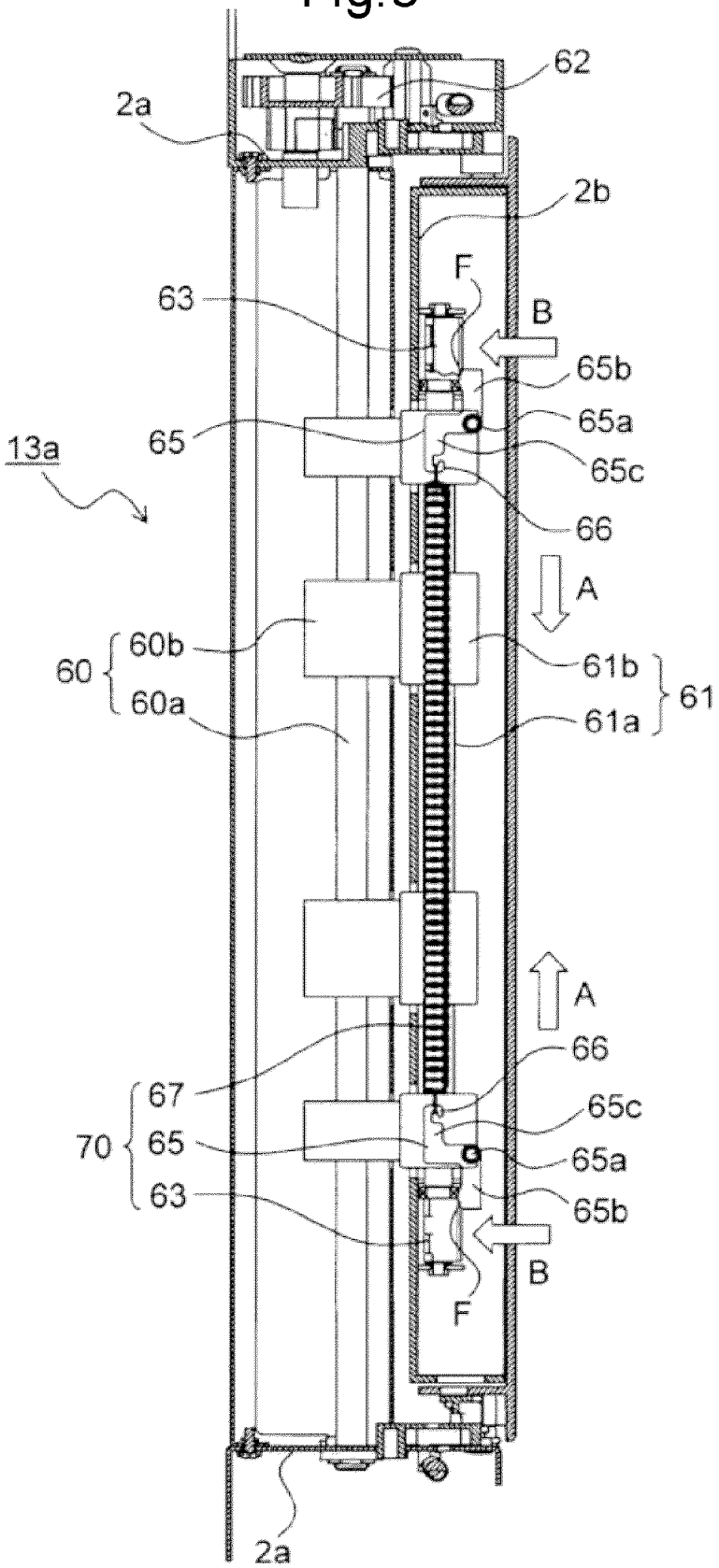
FIG. 3 is top view of the one pair of transport rollers.
Figure 4:
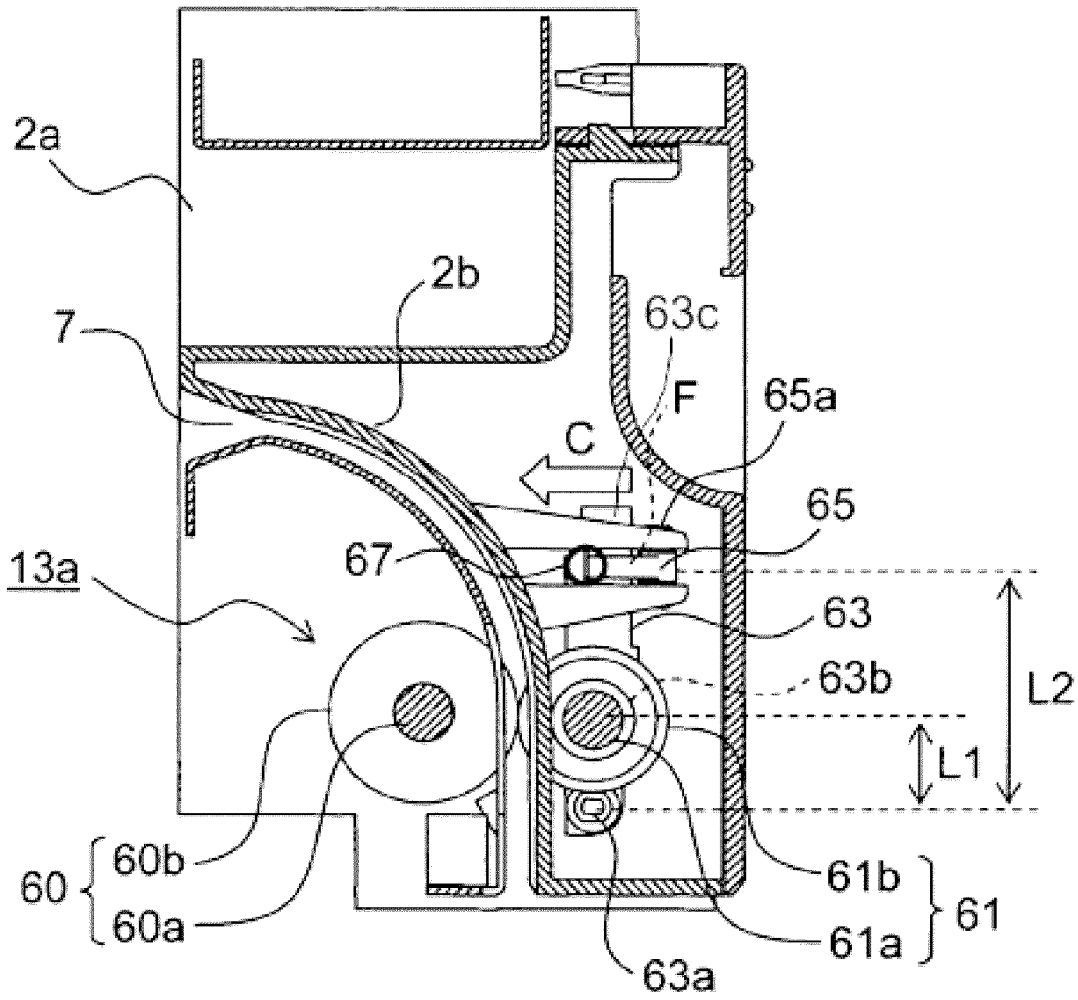
FIG. 4 is a side view when the periphery of the pair of transport rollers in FIG. 1 is viewed in an axial direction.

FIG. 2 is a perspective view of the transport roller pair 13*a* disposed along the first paper transport path 7 in the sheet transport mechanism according to the first embodiment of the present disclosure. FIG. 3 is a top view of the transport roller pair 13*a*, and FIG. 4 is a side view of the periphery of the transport roller pair 13*a*. Also, in FIG. 4, the transport roller pair 13*a* positioned in an uppermost part in FIG. 1 is illustrated.

The transport roller pair 13*a* includes a first roller 60 in which a plurality of (here, four) roller bodies 60*b* are fixed to the outer periphery of a rotary shaft 60*a* in a paper width direction (an upward/downward direction of FIG. 3) and a second roller 61 in which a plurality of (here, four) roller bodies 61*b* are fixed to positions of the outer periphery of a rotary shaft 61*a* facing the roller bodies 60*b*.

The roller body 60*b* of the first roller 60 of a driving side is formed of an elastic material such as rubber, and the roller body 61*b* of the second roller 61 of a driven side is formed of a resin material having a higher hardness than the roller body 60*b*. Thereby, it is possible to enhance a transporting force when the paper is transported by frictional forces of the first roller 60 and the second roller 61.

The rotary shaft 60*a* of the first roller 60 is rotatably supported by one pair of side plate frames 2*a* disposed in front and back directions of the printer main body 2 (a direction perpendicular to the plane of FIG. 1). A drive coupling member 62 to which a driving force from a drive source (not illustrated) such as a motor is input is provided on one end of the rotary shaft 60*a*. In FIG. 4, only the side plate frame 2*a* of one side (the backside of the printer main body 2) is illustrated.

On a guide frame 2*b* disposed between the side plate frames 2*a* of one pair within the printer main body 2 and including an outside transport surface of the first paper transport path 7, one pair of first levers 63 are supported to swing around a first swing shaft 63*a*. The rotary shaft 61*a* of the second roller 61 is rotatably supported by a bearing aperture 63*b* formed at substantially a center of the first lever 63. The first swing shaft 63*a* extends in a direction parallel to the rotary shafts 60*a* and 61*a* of the first roller 60 and the second roller 61 (a direction perpendicular to the plane of FIG. 4), and the first lever 63 swings around the first swing shaft 63*a* in a clockwise direction or a counterclockwise direction of FIG. 4 and thus swings in a direction in which the second roller 61 is close to or separated from the first roller 60.

In addition, on the guide frame 2*b*, one pair of second levers 65 are supported to swing around a second swing shaft 65*a*. The second lever 65 projects from the second swing shaft 65*a* to an end of an axial direction of the second roller 61, and has a top-view crank shape including a first arm portion 65*b* (one end of the second lever 65) abutting the first lever 63 and a second arm portion 65*c* (the other end of the second lever 65) projecting in an L shape from the second swing shaft 65*a* to the center of the axial direction of the second roller 61. A hook portion 66 is formed on a tip end of the second arm portion 65*c* of each second lever 65, and an end of a tension spring 67 (elastic member) is connected thereto. That is, the tension spring 67 connects the second arm portions 65*c* of the second levers 65.

The second swing shaft 65*a* is orthogonal to the rotary shaft 60*a* of the first roller 60 and the rotary shaft 61*a* of the second roller 61, and extends in a direction perpendicular to the plane of FIG. 3 orthogonal to contact and separation directions of the first roller 60 and the second roller 61 (an upward/downward direction of FIG. 4). The second lever 65 swings in a clockwise or counterclockwise direction of FIG. 3 (a horizontal direction of FIG. 4) using the second swing shaft 65*a* as a swing center. The swing direction of the second lever 65 is the contact and separation directions of the second lever 65 for the first roller 60. As described above, in each second lever 65, the second arm portion 65*c* is connected to the tension spring 67, and the first arm portion 65*b* abuts the first lever 63 and moves the first lever 63 in the contact and separation directions. The first lever 63, the second lever 65, and the tension spring 67 constitute a roller pressing mechanism 70 which presses the second roller 61 against the first roller 60.

An operation of the roller pressing mechanism 70 will be described. According to an urging force of the tension spring 67, the second arm portion 65*c* is pulled in a direction of an arrow A. Here, because a tip end (hook portion 66) of the second arm portion 65*c* connected to the tension spring 67 is not on a straight line passing through the second swing shaft 65*a* and the tip end of the first arm portion 65*b*, the second lever 65 swings in a direction of an arrow B. As a result, the first arm portion 65*b* presses an upper portion 63*c* of the first lever 63 in a direction of an arrow C, so that the first lever 63 swings around the first swing shaft 63*a* in the counterclockwise direction of FIG. 4. Thereby, the second roller 61 supported by the bearing aperture 63*b* of the first lever 63 is also pressed against the first roller 60 by swinging in the counterclockwise direction of FIG. 3.

According to the configuration of this embodiment, it is possible to change the direction of the urging force of the tension spring 67 (the direction of the arrow A) to a pressing direction of the second roller 61 (the directions of the arrows B and C) using the first lever 63 and the second lever 65. Thereby, because the tension spring 67 can be disposed along the rotary shaft 61*a* of the second roller 61, it is possible to use a relatively long spring of which the number of turns is large as the tension spring 67 without increasing a size in a width direction of the sheet transport mechanism (the contact and separation directions of the transport roller pair 13*a*). Accordingly, because a spring constant of the tension spring 67 is small, variation in a pressing force of the transport roller pair 13*a* due to a dimension error between the hook portions 66 of the second levers 65 which fix the tension spring 67 is reduced.

In addition, the tension spring 67 is disposed at a position between the rotary shaft 60*a* of the first roller 60 and the rotary shaft 61*a* of the second roller 61 in the contact and separation directions of the second roller 61 for the first roller 60. As a result, as illustrated in FIG. 4, the rotary shafts 60*a* and 61*a* and the tension spring 67 are formed to be disposed in a triangle when viewed in an axial direction. Thereby, because the tension spring 67 can be disposed not to project outwardly from the first roller 60 or the second roller 61 in the width direction of the sheet transport mechanism (the contact and separation directions of the second roller 61 for the first roller 60), a size of the sheet transport mechanism in the width direction can be reduced.

For example, when one pair of pressure portions are configured to directly press both ends of a driven roller, it is necessary to dispose the tension spring on a side opposite the rotary shaft of the transport roller across the rotary shaft of the driven roller. Thus, the rotary shafts of the transport roller and the driven roller and the tension spring are disposed in parallel, and there is a problem in that a size of the width direction of the sheet-material transport apparatus (the contact and separation directions of the roller pair) is increased. On the other hand, in the sheet transport mechanism according to the present disclosure, as described above, the tension spring 67 does not project outwardly from the first roller 60 or the second roller 61 in the width direction of the sheet transport mechanism, so that it is possible to reduce the size of the sheet transport mechanism in the width direction.

In addition as illustrated in FIG. 4, a relationship between a distance L1 from the first swing shaft 63*a* of the first lever 63 to the bearing aperture 63*b* and a distance L2 from the first swing shaft 63*a* to a contact point (operation point) F of the second lever 65 is set to L1<L2, so that weighting (urging force) of the tension spring 67 can be reduced. For example, when L2 is twice L1, the weighting of the tension spring 67 is halved as compared to the case of L1=L2 according to the principle of leverage. That is, it is possible to use the tension spring 67 having a large number of turns and a small spring constant and further suppress variation in a pressing force of the transport roller pair 13*a* due to a dimension error between the hook portions 66 of the second levers 65 which fix the tension spring 67.

Further, an influence of spring tolerance is removed as compared to a configuration in which separate springs are provided at both ends of the axial direction of the second roller 61 by pressing the second roller 61 against the first roller 60 according to one tension spring 67. Accordingly, nip pressures at both the ends of the axial direction of the transport roller pair 13*a* (the front and back directions of the printer main body 2) are uniform and the diagonal transport of paper can be controlled.

By forming a plurality of hook portions 66 on the second arm portion 65*c* of each second lever 65 at different distances from the second swing shaft 65*a* and selecting any hook portion 66 when both ends of the tension spring 67 are connected, the urging force of the tension spring 67, that is, the pressing force of the second roller 61 against the first roller 60, can be adjusted.

Figure 5:
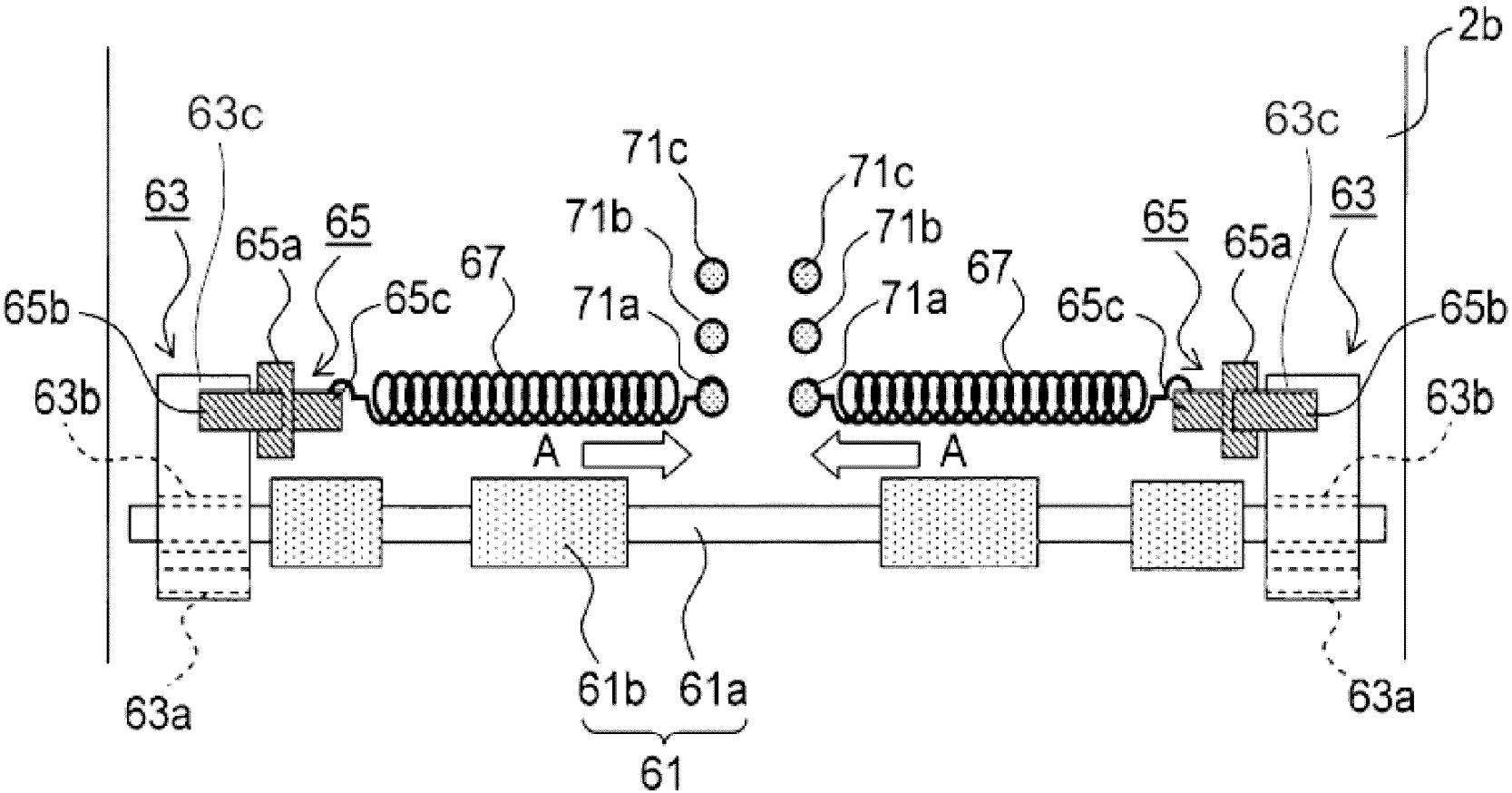
FIG. 5 is a side view when one pair of transport rollers, which are an example of a sheet transport apparatus according to a second embodiment of the present disclosure, is viewed from the side of a second roller.

FIG. 5 is a side view when the transport roller pair 13*a* disposed along the first paper transport path 7 is viewed from the second roller 61 (the right direction of FIG. 4) in a sheet transport mechanism according to a second embodiment of the present disclosure. In this embodiment, the tension spring 67 includes two tension springs 67 and 67. One end of an individual tension spring 67 is connected to each of the second arm portions 65*c* of one pair of second levers 65. In the guide frame 2*b*, engagement portions 71*a* to 71*c* respectively corresponding to the tension springs 67 are provided in a center area of the rotary axial direction of the second roller 61. The engagement portions 71*a* to 71*c* are formed at different distances from the connection portion of one end of the tension spring 67 in the second arm portion 65*c*. One of the engagement portions 71*a* to 71*c* is selected and engaged with the other end of the tension spring 67.

According to the configuration of this embodiment, as in the first embodiment, it is possible to change the direction of the urging force of the tension spring 67 (the direction of the arrow A) using the first lever 63 and the second lever 65 to a pressing direction of the second roller 61 (a direction perpendicular to the plane of FIG. 5). Thereby, because the tension spring 67 can be disposed along the rotary shaft 61*a* of the second roller 61, it is possible to use a relatively long spring of which the number of turns is large as the tension spring 67. Accordingly, because the spring constant of the tension spring 67 is reduced, variation in a pressing force of the transport roller pair 13*a* due to a dimension error between the hook portions 66 of the second levers 65, which fix the tension spring 67, is reduced.

Figure 6:
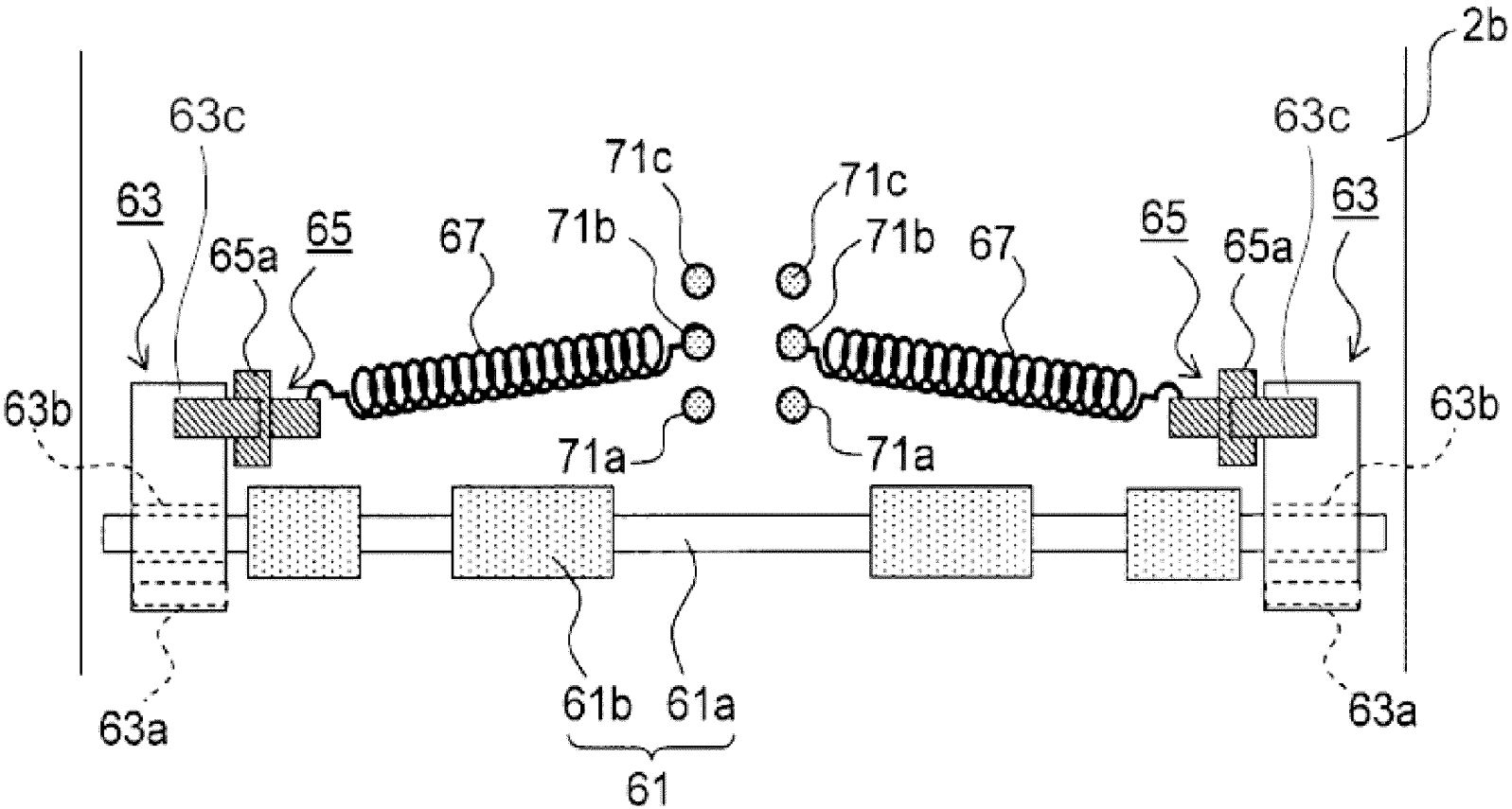
FIG. 6 is a side view of the pair of transport rollers representing a state in which an engagement position of a tension spring is changed from the state of FIG. 5.

In addition, by providing three pairs of the engagement portions 71*a* to 71*c* at different distances from a connection portion of the second arm portion 65*c*, for example, the other end of each tension spring 67 is engaged with the engagement portion 71*b* as in FIG. 6. Thereby, the urging force of each tension spring 67 can be increased as compared to FIG. 5. As a result, the pressing force of the second roller 61 against the first roller 60 (see FIG. 4) is increased. Accordingly, it is possible to easily adjust the pressing force of the second roller 61 against the first roller 60 by selecting one of the engagement portions 71*a* to 71*c* which are engaged with the other end of the tension spring 67.

In addition, the present disclosure is not limited to the above-described embodiments. Various changes can be made without departing from the subject matter of the present disclosure. For example, although an example in which the transport roller pair 13*a* disposed along the first paper transport path 7 serves as the sheet transport mechanism of the present disclosure has been described in the above-described embodiments, it is also equally possible to apply the transport roller pair 13*b* disposed along the second paper transport path 10, the transport roller pair 13*c* disposed along the reverse transport path 12, or the resist roller pair 8.

In addition, the sheet transport mechanism according to the present disclosure is not limited to the inkjet recording color printer 100 as illustrated in FIG. 1, and is applicable to various image forming apparatuses such as a monochromatic copying machine, a digital multi-function machine, a facsimile, and a laser printer.

The configuration according to the above-described sheet transport mechanism according to the present disclosure can be used in a sheet transport mechanism for use in an image forming apparatus such as a facsimile, a copying machine, or a printer. Because a spring constant of an elastic member, which presses a pair of transport rollers, can be reduced using the configuration according to the above-described sheet transport mechanism according to the present disclosure, it is possible to provide a compact sheet transport mechanism, which can prevent the occurrence of skew transport of a recording medium and have a simple configuration by suppressing an influence of a dimension error of a component, which fixes the elastic member, and suppressing variation in pressing forces at both ends of an axial direction of the transport roller pair.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A sheet transport mechanism comprising:

a pair of transport rollers including a first roller which is rotated by a driving force from a drive source, and a second roller which is pressed against the first roller and driven to be rotated, the pair of transport rollers being configured to nip and transport a recording medium in a nip portion between the first roller and the second roller;

a pair of first levers provided at both ends of a rotary shaft of the second roller, each of the pair of first levers having a bearing aperture which rotatably supports the rotary shaft, each of the pair of first levers being configured to swing in directions of contact with and separation from the first roller with a first swing shaft extending in a direction parallel to rotary shafts of the first and second rollers as a rotation center;

a pair of second levers arranged to swing in the directions of contact with and separation from the first roller around second swing shafts each provided orthogonal to the associated first swing shaft and a pressing direction of the second roller and lateral to an associated one of the pair of first levers, the pair of second levers being configured to cause the first levers to move in the directions of contact with and separation from the first roller when one ends of the pair of second levers abut the first levers; and an elastic member connected to the other ends of the pair of second levers and configured to pull the pair of second levers toward a center of the rotary shaft of the second roller in a direction parallel to the rotary shaft of the second roller, the elastic member being disposed at a position between the rotary shaft of the first roller and the rotary shaft of the second roller in the directions of contact and separation of the second roller with and from the first roller, and wherein when the elastic member pulls the other ends of the pair of second levers, the one ends of the pair of second levers swing in a direction toward the pair of first levers being pressed, so that the pair of second rollers are pressed against the pair of first rollers.

2. The sheet transport mechanism according to claim 1, wherein each of the pair of first levers includes an end portion provided with the first swing shaft and another end portion located opposite to the one end portion with the bearing aperture in between and abutting the second lever, and wherein, when a distance from the first swing shaft to the bearing aperture is represented by L1 and a distance from the first swing shaft to a contact point between the first lever and the second lever is represented by L2, L1<L2.

3. The sheet transport mechanism according to claim 1, wherein each of the pair of second levers includes:

a first arm portion which projects from the second swing shaft toward an end of the second roller in an axial direction of the second roller and constitutes the one end of the second lever abutting the first lever; and a second arm portion which projects from the second swing shaft toward a center of the second roller in the axial direction of the second roller and constitutes the other end of the second lever connected to the elastic member, and wherein, when viewed from an axial direction of the second swing shaft, a tip end of the second arm portion is out of a straight line passing through a tip end of the first arm portion and the second swing shaft.

4. The sheet transport mechanism according to claim 1, wherein the elastic member is a single tension spring with both ends connecting the other ends of the pair of second levers.

5. The sheet transport mechanism according to claim 1, wherein the elastic member includes two tension springs, wherein the sheet transport mechanism further comprises two sets of engagement sections provided in a central area of the second roller in the axial direction of the second roller, each set of engagement sections being in correspondence with and being engageable with one of the two tension springs, wherein each of the two sets of engagement sections comprises a plurality of engagement sections disposed at different distances from the other end of the associated second lever, and wherein each of the two tension springs is engaged at the one end with one engagement section of the associated set of engagement sections and connected at the other end to the associated second lever.

6. The sheet transport mechanism according to claim 1, wherein the elastic member includes two tension springs, wherein each of the pair of second levers includes a second arm portion constituting the other end of the second lever and the second arm portion includes a plurality of hook portions formed thereon at different distances from the second swing shaft, and wherein each of the two tension springs is connected at the one end to one of the plurality of hook portions formed on the associated second lever.

7. An image forming apparatus comprising:

a sheet transport mechanism; and an image forming unit configured to form an image on a recording medium transported by the sheet transport mechanism, wherein the sheet transport mechanism includes:

a pair of transport rollers including a first roller which is rotated by a driving force from a drive source, and a second roller which is pressed against the first roller and driven to be rotated, the pair of transport rollers being configured to nip and transport a recording medium in a nip portion between the first roller and the second roller;

a pair of first levers provided at both ends of a rotary shaft of the second roller, each of the pair of first levers having a bearing aperture which rotatably supports the rotary shaft, each of the pair of first levers being configured to swing in directions of contact with and separation from the first roller with a first swing shaft extending in a direction parallel to rotary shafts of the first and second rollers as a rotation center;

a pair of second levers arranged to swing in the directions of contact with and separation from the first roller around second swing shafts each provided orthogonal to the associated first swing shaft and a pressing direction of the second roller and lateral to an associated one of the pair of first levers, the pair of second levers being configured to cause the first levers to move in the directions of contact with and separation from the first roller when one ends of the pair of second levers abut the first levers; and an elastic member connected to the other ends of the pair of second levers and configured to pull the pair of second levers toward a center of the rotary shaft of the second roller in a direction parallel to the rotary shaft of the second roller, the elastic member being disposed at a position between the rotary shaft of the first roller and the rotary shaft of the second roller in the directions of contact and separation of the second roller with and from the first roller, and wherein when the elastic member pulls the other ends of the pair of second levers, the one ends of the pair of second levers swing in a direction toward the pair of first levers being pressed, so that the pair of second rollers are pressed against the pair of first rollers.

* * * * *